United States Patent [19]

Hunter

[11] 3,975,244

[45] Aug. 17, 1976

[54] ELECTROLYTIC REFINING

[75] Inventor: William Hunter, St. Albans, England

[73] Assignee: Brookside Metal Company Limited, London, England

[22] Filed: Sept. 10, 1975

[21] Appl. No.: 612,229

[30] Foreign Application Priority Data

Sept. 23, 1974 United Kingdom .....41336/74

[52] U.S. Cl. ..... 204/108; 204/109; 75/101 BE; 423/24

[51] Int. Cl.[2] ..... C25C 1/12; C25C 1/20

[58] Field of Search ..... 75/101 R, 101 BE; 423/24; 204/109, 108

[56] References Cited

UNITED STATES PATENTS

| | | | |
|---|---|---|---|
| 3,224,873 | 12/1965 | Swanson | 75/101 |
| 3,674,464 | 7/1972 | Chiola et al. | 423/54 |

*Primary Examiner*—R. L. Andrews

*Attorney, Agent, or Firm*—Buell, Blenko & Ziesenheim

[57] ABSTRACT

In the electrolytic refining of silver that contains a significant amount of copper, the electrolyte is withdrawn from the refining cell, preferably continuously but alternatively at intervals, and is contacted with an immiscible liquid phase containing a selective complexing agent for cupric ions. The liquid phase carries away at least some copper from the electrolyte without the need to remove the silver first. The treated electrolyte, depleted of copper, is re-usable and is normally returned to the cell. In a continuous-withdrawal system a steady copper level can be maintained in the electrolyte. The complexing-agent phase can be regenerated and copper recovered from it.

14 Claims, 1 Drawing Figure

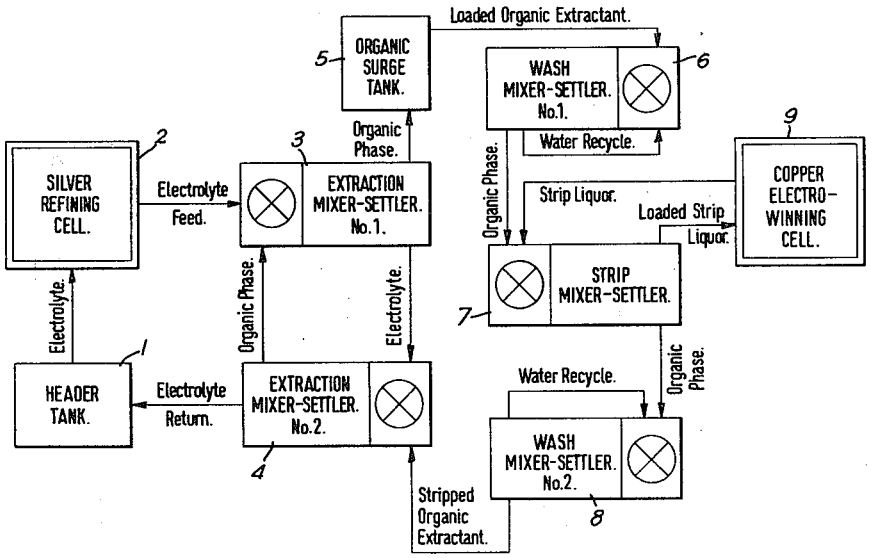

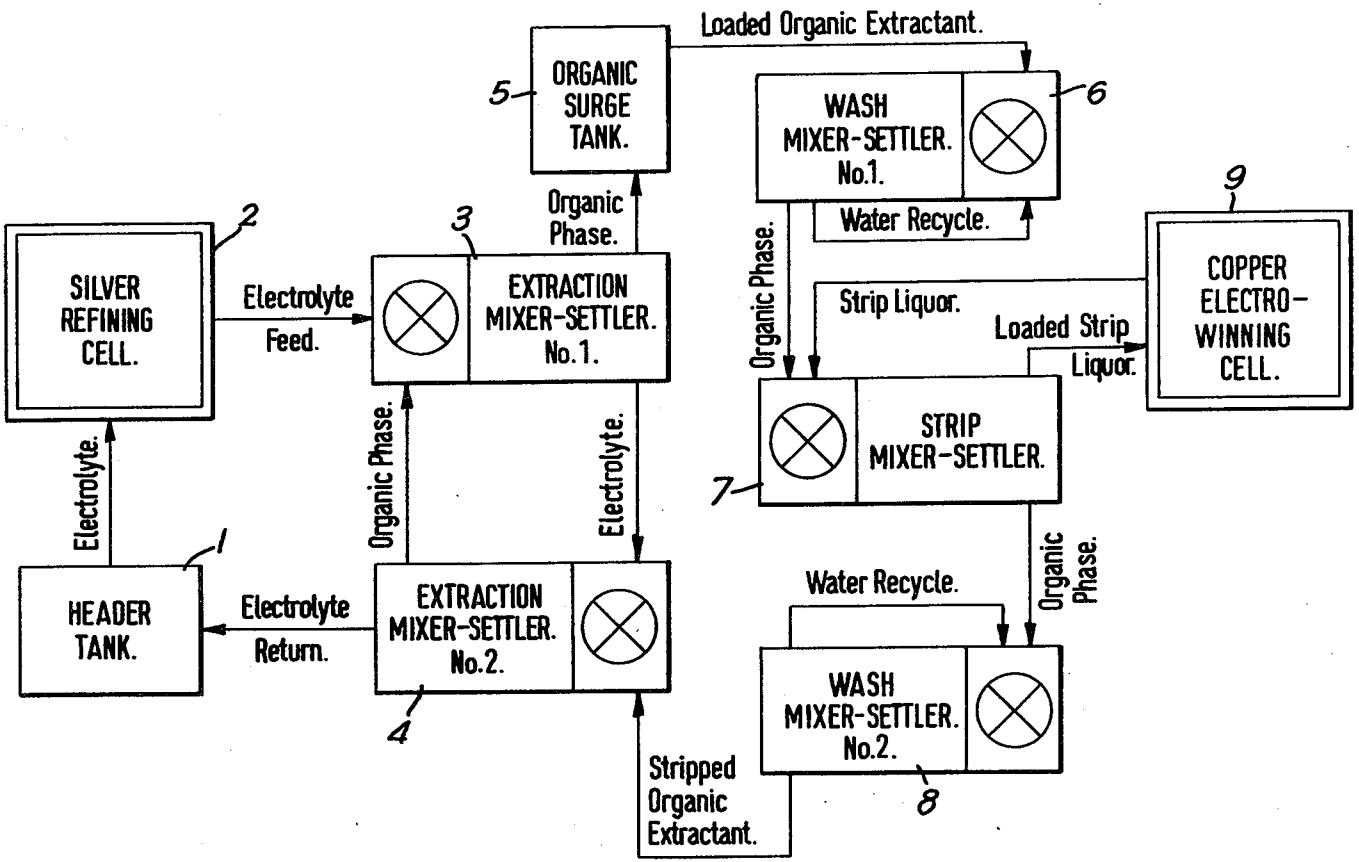
COPPER ELECTRO-WINNING CELL.
9
Loaded Strip Liquor.
Strip Liquor.
STRIP MIXER-SETTLER.
7
Organic Phase.
WASH MIXER-SETTLER. No.1.
6
Water Recycle.
Organic Phase.
Loaded Organic Extractant.
WASH MIXER-SETTLER. No.2.
8
Water Recycle.
Stripped Organic Extractant.
ORGANIC SURGE TANK.
5
Organic Phase.
EXTRACTION MIXER-SETTLER. No.1.
3
Electrolyte.
EXTRACTION MIXER-SETTLER. No.2.
4
Organic Phase.
Electrolyte Feed.
Electrolyte Return.
SILVER REFINING CELL.
2
Electrolyte.
HEADER TANK.
1

ELECTROLYTIC REFINING

This invention relation to electrolytic refining and more particularly to the purification of silver that contains copper as a significant impurity. Silver is conventionally refined to a "fineness" (purity in parts per thousand) of 999 to 999.9 by electrolysis in aqueous silver nitrate solution.

Two forms of cell are in current use, the Mőbius cell with vertical electrodes, which is a high-speed cell but requires an input of anodes containing at least about 95% silver for economic operation by conventional techniques, and the Thum (or Balbach/Thum) cell with horizontal electrodes, which is a much slower cell (in the sense that the rate of deposition of silver per unit of electrolyte volume is smaller) but can be operated economically with a much less pure infeed, say down to 80% silver. In both cases fabric partitions are used to segregate anode slimes and the purified silver is temporarily deposited on an inert cathode (e.g. stainless steel) from which it is scraped periodically to be collected in crystalline form.

Copper is almost always a significant impurity in unrefined silver, whether derived from scrap or from ore, and it necessary to limit copper build-up in the electrolyte at such a level that deposition and occlusion of copper or copper salts at the cathode are both negligible; for a conventional silver nitrate bath operating at a pH of about 1.5 – 2.5 and with a silver concentration in the range 60 – 160 g/l, a copper concentration of 60 g/l is widely considered the highest allowable.

When the limiting copper concentration is reached some fraction, often half, of the foul electrolyte is removed and the cell topped up with (at least relatively) copper-free silver nitrate solution. The foul electrolyte must then be processed to recover the silver and copper it contains and to render it fit for disposal, or better, for re-use. Three processes have conventionally been used:

1. silver is separated by cementation with scrap copper; copper is separated by cementation with scrap iron and the solution is neutralised and discarded; or
2. silver is precipitated with sodium sulphite and copper with alkali and the solution discarded; or
3. silver is precipitated with sodium chloride as chloride, subsequently reduced with iron, copper is separated by cementation with scrap iron and the solution neutralised and discarded.

Certain improved processes have been devised in recent years, but these have still involved elimination of the silver from the foul electrolyte before copper is removed.

It is an object of the invention to remove copper without first eliminating the silver, and in accordance with the invention, electrolyte removed from the electrolytic refining cell is treated by contacting it with a separate immiscible liquid phase comprising a selective complexing agent for cupric ions until its copper content is at least substantially reduced, to make it suitable for subsequent re-use in silver refining. Normally the treated electrolyte will be re-used in the same silver-refining cell (or cell system, if several cells share electrolyte processing equipment).

By a "selective" complexing agent is meant one which binds cupric ions to form a complex ion that predominantly remains in the separate phase and which binds then much more strongly than it binds silver ions; it is, of course, preferable that substantially no silver should be complexed but this is not essential since small amounts of silver can be recovered easily and efficiently prior to a subsequent electrolytic copper-refining process. Nor is it essential for all the copper to be removed in any individual treatment: all that is required is that in the long term as much copper is removed from the electrolyte as enters it and that the copper content never rises to an unacceptable level.

Several suitable selective complexing agents are known and are commercially available since they are used for concentration of copper values leached from low-grade ores. Examples are i. the 2-hydroxyl benzophenone oxime derivatives sold by General Mills Inc. under the trademark "LIX";
ii. the 8-hydroxy quinoline derivatives sold by Ashland Chemical Co. under the trademark "KELEX", especially KELEX 100 which is a 7-dodecenyl 8-hydroxyl quinoline; and
iii. 2-hydroxy 5-nonyl acetophenone oxime available from Shell International under the reference SME 529 (previously RD539)

All these selective complexing agents are preferably used in conjunction with a diluent, suitable petroleum-based (Kerosene) diluents being recommended by the suppliers: the function of the diluent is to produce a non-aqueous phase of low viscosity that contacts the aqueous phase efficiently.

A batch of foul electrolyte may be removed and treated when the copper content of the bath reaches a predetermined maximum value, to this extent following conventional practice; but the invention could be used in several other ways. For example, the whole of the foul electrolyte might be drained, treated and returned to the cell before operation restarted or, at the other extreme, electrolyte could be continuously withdrawn, treated and returned to the cell or system so as to maintain a practically constant copper content in the cell or system; in fact continuous processing may well be preferable.

The liquid phase containing the complexing agent can be contacted with the electrolyte in a variety of ways. At present it is considered preferable to contact by stirring in a suitable vessel, though satisfactory results have also been obtained by passing the liquids in opposite directions through a packed column. After contacting, the liquids are allowed to separate out and will usually be decanted from one another.

Normally it will be necessary to regenerate the complexing agent for re-use by stripping the copper from it, and with the preferred materials described above this can be done by contact with a more strongly acid aqueous phase, for example sulphuric acid at a concentration of about 150 g/l: the resultant acidic copper sulphate solution is suitable for direct electrolysis to recover the copper, after removing any silver, e.g. by cementation with metallic copper: the spent sulphate electrolyte can be re-used to regenerate more complexing agent.

It may perhaps prove possible to remove base metals from the electrolyte with the copper by judicial selection of complexing agent(s) and processing conditions, for example the complexing agent SME 529 described above of used in more nearly neutral solution (about pH 4 – 5) might remove some iron with the copper (or two applications at different acidities could be used).

The same complexing agent will also extract nickel under suitable conditions at a pH around 5.5.

Advantages of the invention over conventional techniques include the following:

1. the considerable cost of regularly buying in or preparing large quantities of silver nitrate and purified water for the fresh electrolyte is eliminated.
2. The cost of disposing of spent electrolyte is also avoided or at least (if other base metals accumulate and cannot be removed) very much reduced.
3. Copper is obtained in a convenient form for recovery
4. Processing of silver precipitates is eliminated or at least greatly reduced.
5. The cell can be operated at a lower copper limit (e.g. 30 g/l instead of the usual 60 g/l) to obtain silver of higher fineness (some copper content may be desirable to maintain the conductivity of the electrolyte and to harden the deposited silver).
6. Copper can be removed at greater rate, if required, permitting use of input material of lower quality, so eliminating or reducing preliminary purification steps.

These advantages can be obtained with compact and inexpensive plant.

The invention includes apparatus for use in the refining method described herein.

The accompanying drawing is a flow diagram showing one method of using the invention to recover both refined silver and refined copper.

A header tank 1 supplies a silver nitrate electrolyte to a silver-refining electrolytic cell 2 which operates conventionally. Electrolyte is withdrawn from the cell (intermittently or preferably continuously) and is fed to the mixer of the first of two extraction mixer-settler units 3, 4 in each of which is agitated with an organic phase containing the selective complexing agent and then allowed to settle out, the organic phase passing through the mixer-settler unit 4 before the mixer-settler unit 3, that is passing through them in the reverse order to that followed by the electrolyte. From the settler compartment of the second unit the electrolyte returns to the header tank 1 and in due course to the cell.

The organic phase, loaded with copper complex, passes from the settler compartment of the first mixer-settler unit 3 to a surge tank 5 and then to a first wash mixer-settler 6 in which it is washed with water, to reduce any carry-over of nitric acid; the wash water is recycled until significantly contaminated and is then discarded. The copper-bearing organic phase now enters a strip mixer-settler 7 in which it is agitated with an acid copper sulphate liquor, which hydrolyses the copper complex and carries away the bulk of the copper value from the organic phase. The stripped organic phase is washed in a second wash mixer-settler 8, similar to 6, to reduce any carry-over of sulphuric acid, after which it returns to the second extraction mixer-settler 4 for re-use.

The copper-bearing strip liquor obtained as the aqueous fraction from the strip mixer-settler 7 may be treated, e.g. by cementation with metallic copper, to remove any significant traces of silver (not shown); after this treatment (or immediately, if separation has been sufficiently clean) it passes to an electrowinning cell in which refined metallic copper is recovered from it by electrolysis. The electrolyte from this cell, or the spent electrolyte if a batch process is used, provides the acid copper sulphate strip liquor for use in the strip mixer-settler 7.

In a specific example, a nitrate electrolyte has a pH of 1.5 and contains 60 g/l of silver and 30 g/l of copper. To maintain a steady condition, the electrolyte is continuously withdrawn from the electrolytic refining bath (a Möbius cell at a rate of 75 ml/sec (1 imperial gallon per minute) and passed in succession through two mixers into both of which is fed at 75 ml/sec but in the reverse order a solution consisting of the complexing agent SME 529 described above diluted with 4 times its own volume of kerosene (sold by Shell International under the designation MSD 210). After settling, the aqueous phase is returned to the electrolytic cell through a header tank. The kerosene phase containing 9.21 g/l of copper passes via a water wash to a second mixer into which is fed, also at a rate of 75 ml/sec, a spent copper electrowinning liquor comprising 30 g/l of copper sulphate (calculated as metal) and 150 g/l of sulphuric acid. After separation, the kerosene phase, now containing only 0.46 g/l of copper is washed again and then recycled to the first pair of mixers, and the copper liquor is returned to the copper electrowinning cell. In this way copper is transferred from the silver refining cell to the copper electrowinning cell at a rate of approximately 0.66 g/sec (8.75 g per liter of any one of the three main fluids cycled).

What I claim as my invention is:

1. A method of electrolytically refining silver that contains copper as a significant impurity comprising passing electric current through an electrolyte containing silver ions and cupric ions between an anode of said silver and a cathode both immersed in said electrolyte in an electrolytic refining cell, removing electrolyte from said cell, and contacting said electrolyte outside said cell with a separate immiscible liquid phase comprising a selective complexing agent for said cupric ions until its copper content is at least substantially reduced, to make it suitable for reuse in silver refining.

2. A method as claimed in claim 1 comprising regenerating said complexing agent by stripping the copper from it.

3. A method as claimed in claim 2 in which said complexing agent is regenerated by treatment with an aqueous phase more strongly acid than said electrolyte.

4. A method as claimed in claim 3 in which said more strongly acid aqueous phase comprises sulphric acid and in which copper is recovered from it by direct electrolysis after removing any silver therefrom.

5. A method as claimed in claim 4 in which, after recovery of copper by said direct electrolysis, the spent sulphate electrolyte is reused to regenerate more of said complexing agent.

6. A method as claimed in claim 1 comprising returning said electrolyte after so treating it to said cell.

7. A method as claimed in claim 6 in which a batch of said electrolyte is removed from said cell and treated when its copper content reaches a predetermined upper limit.

8. A method as claimed in claim 1 in which said selective complexing agent is an 8-hydroxy quinoline derivative.

9. A method as claimed in claim 8 in which said derivative is 7-dodecenyl 8-hydroxy quinoline.

10. A method as claimed in claim 1 in which the whole of the electrolyte is drained from the cell or cell system, treated, and returned to the cell or cell system before operation of the cell or cells restarts.

11. A method as claimed in claim 1 in which said selective complexing agent is a 2-hydroxy benzophenone oxime derivative.

12. A method as claimed in claim 1 in which said selective complexing agent is 2-hydroxy 5-nonyl acetophenone oxime.

13. A method as claimed in claim 1 in which said immiscible liquid phase comprises a diluent.

14. A method of refining silver that contains copper as a significant impurity by passing electric current through an electrolyte containing silver ions and cupric ions between an anode of said silver and a cathode both immersed in said electrolyte in an electrolytic refining cell constituting at least part of a refining cell system, comprising continuously removing electrolyte from said cell, contacting said electrolyte outside said cell with a separate immiscible liquid phase comprising a complexing agent for cupric ions until its copper content is at least substantially reduced, and afterwards returning said electrolyte to an electrolytic refining cell of said system to maintain a substantially constant copper content in each said cell.

* * * * *